US005957013A

United States Patent [19]

Frazer

[11] Patent Number: 5,957,013

[45] Date of Patent: Sep. 28, 1999

[54] HAND TOOL WITH RETRACTABLE JAW ASSEMBLY

[75] Inventor: Spencer Frazer, Edmonds, Wash.

[73] Assignee: SOG Specialty Knives, Inc., Lynnwood, Wash.

[21] Appl. No.: 09/184,517

[22] Filed: Nov. 2, 1998

Related U.S. Application Data

[63] Continuation of application No. 08/649,041, May 16, 1996, Pat. No. 5,829,329.

[51] Int. Cl.[6] ..... B25B 7/00

[52] U.S. Cl. ..... 81/427.5; 81/416; 81/177.6; 30/255

[58] Field of Search ..... 81/427.5, 415–417, 81/177.4, 177.6, 489–490; 7/118, 125–131, 135, 167–168; 30/255, 152, 159–161, 191–193, 252

[56] References Cited

U.S. PATENT DOCUMENTS

| | | |
|---|---|---|
| 580,235 | 4/1897 | Strum . |
| 649,334 | 5/1900 | Meloos . |
| 1,370,906 | 3/1921 | Newton . |
| 1,467,661 | 9/1923 | Undy . |
| 1,511,340 | 10/1924 | Jackson . |
| 1,524,694 | 2/1925 | Di Maio . |
| 2,575,652 | 11/1951 | Bovee . |
| 2,826,813 | 3/1958 | Flocke . |
| 4,238,862 | 12/1980 | Leatherman . |
| 4,502,220 | 3/1985 | Aoki . |
| 4,535,539 | 8/1985 | Friedman . |
| 4,563,833 | 1/1986 | Aucoin . |
| 4,744,272 | 5/1988 | Leatherman . |
| 4,888,869 | 12/1989 | Leatherman . |
| 5,029,355 | 7/1991 | Thai . |
| 5,062,173 | 11/1991 | Collins et al. . |
| 5,142,721 | 9/1992 | Sessions et al. . |
| 5,212,844 | 5/1993 | Sessions et al. . |
| 5,267,366 | 12/1993 | Frazer . |
| 5,564,318 | 10/1996 | Pail . |

FOREIGN PATENT DOCUMENTS

| | | |
|---|---|---|
| 30788 | 8/1884 | Germany . |
| 17248 | 6/1896 | United Kingdom . |
| 112111 | 12/1917 | United Kingdom . |

*Primary Examiner*—D. S. Meislin
*Attorney, Agent, or Firm*—Christensen O'Connor Johnson & Kindness PLLC

[57] ABSTRACT

Opposing jaw members of a hand tool are interconnected by a first pivot and have working end portions swingable toward and away from each other. The assembly of interconnected jaws is itself pivotally mounted on one or more handles that define a housing for the jaw assembly. The jaw assembly is swingable relative to the housing between a compact, closed position in which the jaws are concealed and an open, extended, working position in which the jaws are exposed. A second handle pivoted to the first handle can be manipulated to effect relative movement of the jaws when the jaws are in the open position.

10 Claims, 4 Drawing Sheets

72
68
90
66
56
110
112
60
28
24
58'
52
46
50
12
48'
114
62'
14
44'
54'

HAND TOOL WITH RETRACTABLE JAW ASSEMBLY

This application is a continuation of my U.S. patent application Ser. No. 08/649,041 filed May 16,1996, titled "Hand Tool With Retractable Jaws," U.S. Pat. No. 5,829, 329, dated Nov. 3, 1998.

FIELD OF THE INVENTION

The present invention relates to a tool having opposed jaws, such as pliers, pincers, shears, or scissors, that can be retracted to a position nested inside one or more handles which act as a housing for the jaw assembly.

BACKGROUND OF THE INVENTION

The devices disclosed in the following patents are representative of hand tools having jaws or handles movable or foldable between open or extended working positions for normal use of the tools and closed or retracted positions in which the tools are more compact and/or the jaws are concealed:

| Patent No. | Inventor(s) | Country |
|---|---|---|
| 580,235 | Strum | U.S. |
| 649,334 | Meloos | U.S. |
| 1,467,661 | Undy | U.S. |
| 1,370,906 | Newton | U.S. |
| 1,467,661 | Undy | U.S. |
| 1,511,340 | Jackson | U.S. |
| 1,524,694 | Maio | U.S. |
| 2,575,652 | Bovee | U.S. |
| 4,238,862 | Leatherman | U.S. |
| 4,502,220 | Aoki | U.S. |
| 4,563,833 | Aucoin | U.S. |
| 4,744,272 | Leatherman | U.S. |
| 4,888,869 | Leatherman | U.S. |
| 5,029,355 | Thai | U.S. |
| 5,062,173 | Collins et al. | U.S. |
| 5,142,721 | Sessions et al. | U.S. |
| 5,212,844 | Sessions et al. | U.S. |
| 5,267,366 | Frazer | U.S. |
| 112,111 | Lea | U.K. |
| 17,248 | Schmidt | U.K. |
| 30,788 | Klever | German |

In the tools disclosed in the above patents, one or more of the jaw members slide or swing relative to handles, and/or the handles themselves can be folded.

In some constructions, the opposing jaw tools are designed for special purposes and/or are so small as to constitute novelties of limited utility.

In other constructions, the jaws of the tools continue to be exposed. For sharp jaw members, this increases the prospects of injury. For grasping tools, the jaws can collect grease and dirt, making it undesirable that they be carried in a pocket, for example.

In some constructions, the tools are not convenient and comfortable to use, and/or are of complicated expensive construction.

Therefore, there continues to be a need for a novel construction which is adaptable to different types of opposing jaw tools, which assures nesting of the opposing jaws in a handle or housing, which allows the jaws to be quickly and easily deployed to an open, working condition, and which allows essentially full-size jaws to be used in a convenient and comfortable manner.

SUMMARY OF THE INVENTION

The present invention provides a hand tool with retractable jaws meeting the objectives stated above. In a first embodiment, opposing jaw members are interconnected by a first pivot and preferably have working end portions biased apart by a spring. The construction limits the maximum degree of swinging of one jaw relative to the other. The interconnected jaws fit between top and bottom plates of a first handle which also acts as a housing for the tool. A second handle in the form of an operating lever has a flat top plate fitted between the jaw assembly and the housing top plate. The interconnection of the jaw assembly and second handle with the housing is also accomplished a pivot. Preferably, a second spring is provided for biasing the jaw assembly out of the housing toward an extended, open, working position. Nevertheless, a releasable latch mechanism is provided to normally maintain the jaws in the closed or retracted position nested within the housing.

The second handle or operating lever is interconnected with the jaws so as to allow the jaws to swing past the operating lever when the latch mechanism is released. The jaws automatically swing to the extended position in which one jaw is locked relative to the housing, while the operating lever swings through a smaller angle to allow it and the first handle to be grasped by a user. In that position, the other jaw interacts with the operating lever such that the lever can be manipulated to move the unlocked jaw toward and away from the locked jaw for operation of the tool. The latch mechanism can be actuated to release the locked jaw and permit the jaws to be swung as a unit to the closed position.

In the first embodiment described above, the first handle forms the housing and the other nests within the first. In a second embodiment, two handles cooperate to form a housing into which the jaws are normally retracted. One handle has a side opening through which the jaws swing when moving from the closed, retracted position to the open, extended position.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The present invention provides a hand tool having cooperating jaw members pivoted together such that working end portions of the jaw members are movable toward and away from each other. In addition, the jaw members are swingable between retracted, closed positions received in a handle or handles and extended, open positions for manual operation of the tool. Although the invention is illustrated and described below with reference to pliers, the jaw members could be cooperating pincers, shears, scissors, etc.

Figures 1, 2, 5:
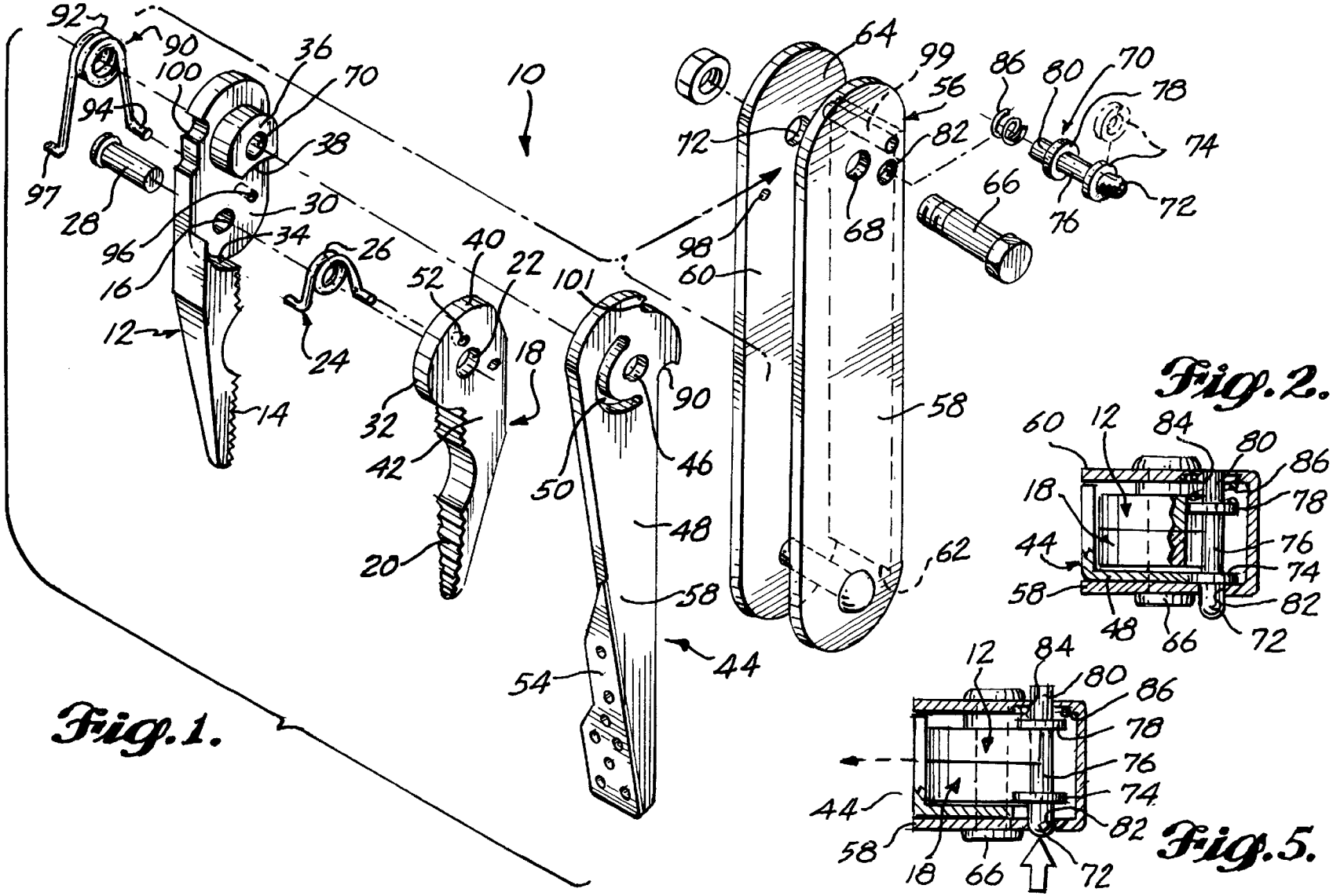
FIG. 1 is a top perspective of a hand tool with retractable jaws in accordance with the present invention, with parts shown in exploded relationship.
FIG. 2 is an enlarged end elevation of the tool of FIG. 1, with the parts assembled, some parts being broken away to reveal a latch mechanism.
FIG. 5 (on the drawing sheet with FIG. 1) is an enlarged end elevation corresponding to FIG. 2, with parts in different positions.

In the embodiment illustrated in FIG. 1, the hand tool 10 in accordance with the present invention includes a first jaw 12 having a working end portion 14 extending generally radially from a pivot hole 16. A second jaw 18 has a working end portion 20 extending generally radially from a corresponding pivot hole 22. A torsion spring 24 is interconnected between jaws 12 and 18 and can include a helical portion 26 for receiving the pivot pin or rivet 28 which pivotally interconnects the two jaws for swinging about a first axis.

The first jaw 12 has a recessed portion 30 for receiving a generally cylindrical hub portion 32 of the second jaw 18. The thickness of hub portion 32 is approximately one-half the thickness of the immediately adjacent part of the working end portion 20, approximately equal to the depth of the recess 30. Recess 30 is bounded at one side of pivot hole 16 by an arcuate shoulder 34 formed at the adjacent inner end portion of the jaw working end portion 14, and at the other side of pivot hole 16 by a boss 36. The side 38 of boss 36 facing the pivot hole 16 is also arcuate. The arcuate shoulder 34 of the jaw working end portion 14 and arcuate face 38 of boss 36 are shaped to ride along the periphery of the hub portion 32 of the second jaw 18 as the second jaw swings relative to the first jaw.

Spring 24 applies a force tending to bias the working end portions 14 and 20 of the two jaws apart. In one direction, swinging of the two jaws is limited by engagement of the jaw working end portions. In the other direction, relative opening of the two jaws is limited by the shape of hub 32 and the side 38 of boss 36. For example, hub 32 can have a non-cylindrical protrusion 40 which cooperates with boss 36 to limit the maximum opening of the jaw working end portions to an angle of 20 or 30 degrees. When the two jaws are assembled, the flat outer or top face 42 of jaw 18 is substantially flush with the top face of boss 36 and the working end portion 14 ofjaw 12.

The tool in accordance with the present invention includes a first handle 56 having a top plate 58 and a bottom plate 60 interconnected along one edge by a web 62. A second handle 44 in the form of an operating lever is swingably mounted in the channel 64 between the top and bottom plates 58 and 60 by a pivot bolt 66 defining a second axis parallel to but offset from the first axis. The assembly of jaw members 12 and 18 also is swingably mounted in the channel 64 by bolt 66. More specifically, bolt 66 extends through a hole 68 in one end portion of the top plate 58, then through a hole 46 in one end portion of the second handle 44, then through a bore 70 through the boss 36 of jaw 12, and then through a hole 72 of bottom plate 60, aligned with hole 68.

The second handle or lever includes a flat plate section 48 that overlies the interconnected jaws. Plate 48 has an arcuate slot 50 defining a segment of a circle centered about the axis of hole 46. Slot 50 receives a short peg 52 projecting upward from the second jaw 18. The swinging end portion of lever 44 is of L cross-section, including a flange 54 projecting downward from plate 48. As described in more detail below, flange 54 defines an opening through which the interconnected jaws can swing about the axis of the pivot bolt 66. During such swinging movement, peg 52 slides in the arcuate slot 50.

A latch mechanism 70 is provided for normally retaining the jaws and handle 44 nested between the top and bottom plates 58 and 60 of handle 56. Such mechanism consists of a latch pin having a top button portion 72, a narrow upper enlarged section 74, a central reduced diameter section 76, a narrow lower enlarged portion 78, and a bottom guide section 80. FIG. 2 shows the mounting of the latch pin to the handle 56. Button 72 projects through a hole 82 in the top plate 58; whereas the guide section 80 at the other end extends through a hole 84 through the bottom plate 60. A small helical compression spring 86 is engaged between the inner side of plate 60 and the narrow lower enlargement 78 of the latch pin for normally biasing the pin to the position shown in FIG. 2 in which the upper enlargement 74 is engaged against the top plate 58. In such position, the lower enlarged section 78 is aligned with the first jaw 12 and the upper enlarged section 74 is aligned with the flat plate section 48 of handle or lever 44.

Figures 3, 4, 6, 7:
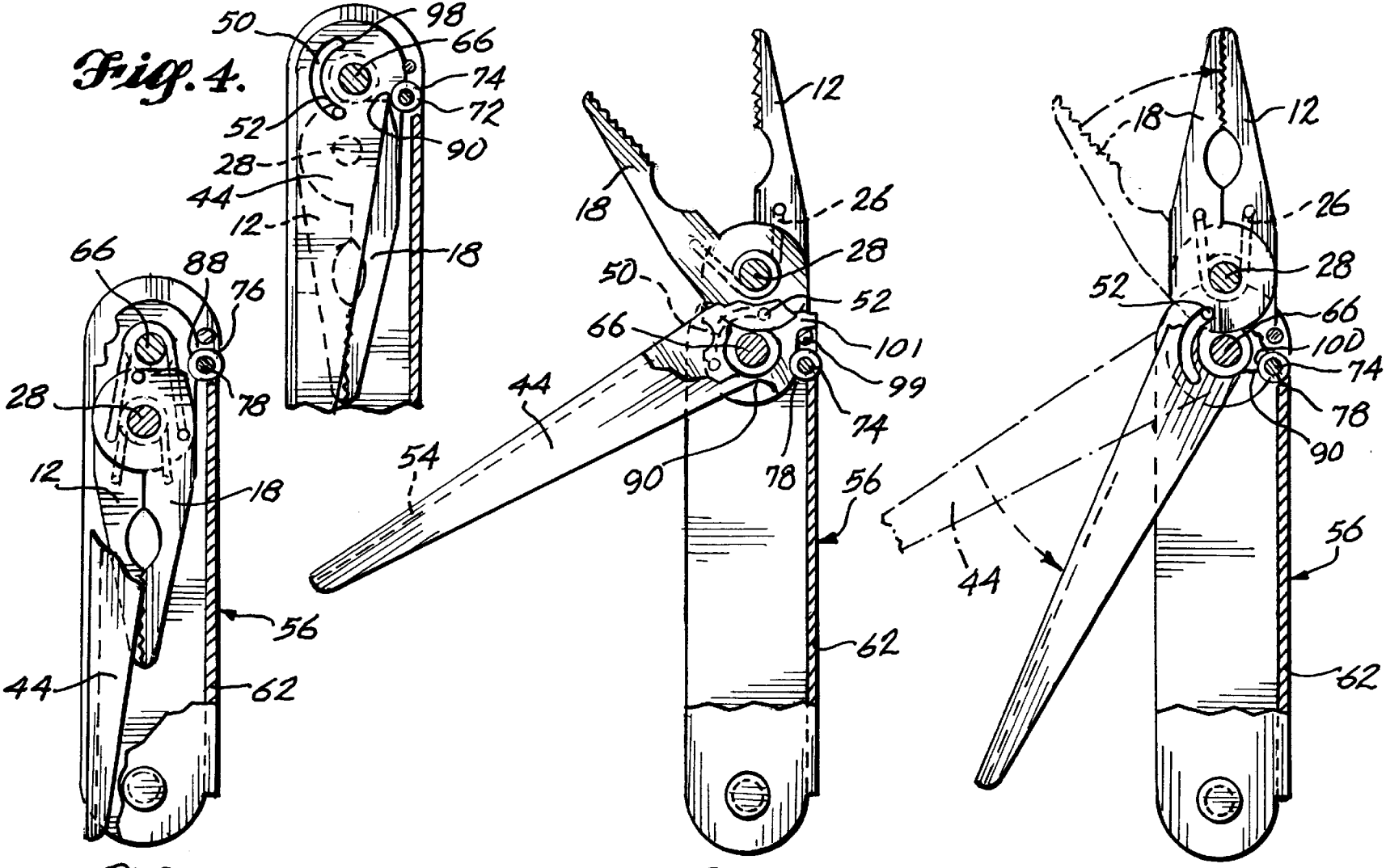
FIG. 3 is a top plan of the tool of FIG. 1 with parts assembled and some parts broken away, showing the tool in a closed condition.
FIG. 4 is a corresponding top plan with parts broken away.
FIGS. 6 and 7 are corresponding top plans of the tool of FIG. 1 with parts in different positions and showing the tool in an open condition.

With reference to FIG. 3, with the latch pin in the position illustrated in FIG. 2, the lower enlargement 78 is received in a notch 88 of jaw 12, thereby locking the jaw in the closed position. Similarly, as seen in FIG. 4, the upper enlargement 74 of the latch pin is received in a notch 90 of the second handle or lever 44, thereby preventing outward rotation of the lever.

To release the lever and jaws, the latch pin is moved to the position shown in FIG. 5, in which the lower enlargement 78 no longer is aligned with jaw 12 and the upper enlargement 74 no longer is aligned with the lever. Referring again to FIG. 3, the reduced diameter central section 76 of the latch pin is positioned so as not to interfere with outward swinging of jaw 12. Similarly, referring to FIG. 4, the top button portion 72 of the latch pin will not interfere with outward swinging of lever arm 44 when the button is depressed, and there is no other obstacle to outward swinging of either the lever or interconnected jaws about the axis of bolt 66.

Preferably, a torsion spring 90, best seen at the left of FIG. 1, has its opposite ends interconnected between the first jaw 12 and the bottom plate 60 of handle 56. More specifically, spring 90 has a central helical portion 92 through which the pivot bolt 66 extends. One leg of spring 90 has a hooked end 94 received in a small hole 96 of jaw 12, and a second leg of the spring has a hooked end 97 received in a small hole 98 of bottom plate 60. Thus, when the latch pin is depressed, the force of spring 90 immediately swings jaws 12 and 18 from the closed position shown in FIGS. 3 and 4 toward the open position shown in FIGS. 6 and 7. Initially, peg 52 projecting from the upper jaw 18 merely rides in the arcuate slot 50 of the lever arm (see, for example, the relative positions of the peg 52 and slot 50 in FIG. 4 where the peg fits toward one end of the slot). Jaw 12, and jaw 18 carried thereby, swing past the flanged side of the lever. After a predetermined angle of swing, however, peg 52 engages the opposite end 98 of the slot, thereby forcing the lever to rotate with the jaws, but through a much smaller angle than the jaw assembly. The maximum rotation is limited by a stop pin 99 on handle 56 engaging in a notch 101 of the lever. Ultimately, the position of FIG. 6 is reached. Jaws 12 and 18 are biased to the position illustrated by the spring 26 with their working end portions spaced apart, and lever 44 is forced to the angular position illustrated by engagement of peg 52 with the end of the arcuate slot 50. Preferably, the latch pin is released at or prior to this point, such that the bottom enlargement 78 engages in a second notch 100 formed in jaw 12 to lock that jaw relative to the handle 56. From that position, handle 44 can be moved manually toward handle 56 by grasping the flange 54, which has the effect of moving the jaws together as illustrated in FIG. 7, for operation of the hand tool.

When desired, the components can be moved back to the closed or retracted positions by depressing the latch pin which again moves the lower enlargement 78 out of engagement with the notch 100 and permits the jaws to be swung counterclockwise from the position shown in FIGS. 6 and 7 back to the position shown in FIGS. 3 and 4. When the latch pin is released, the lower enlargement 78 engages in the notch 88 at the opposite side of jaw 12 from notch 100, and the upper enlargement 74 engages in the notch 90 of lever arm 44. The tool is back in the closed position with the jaws concealed.

Figure 8:
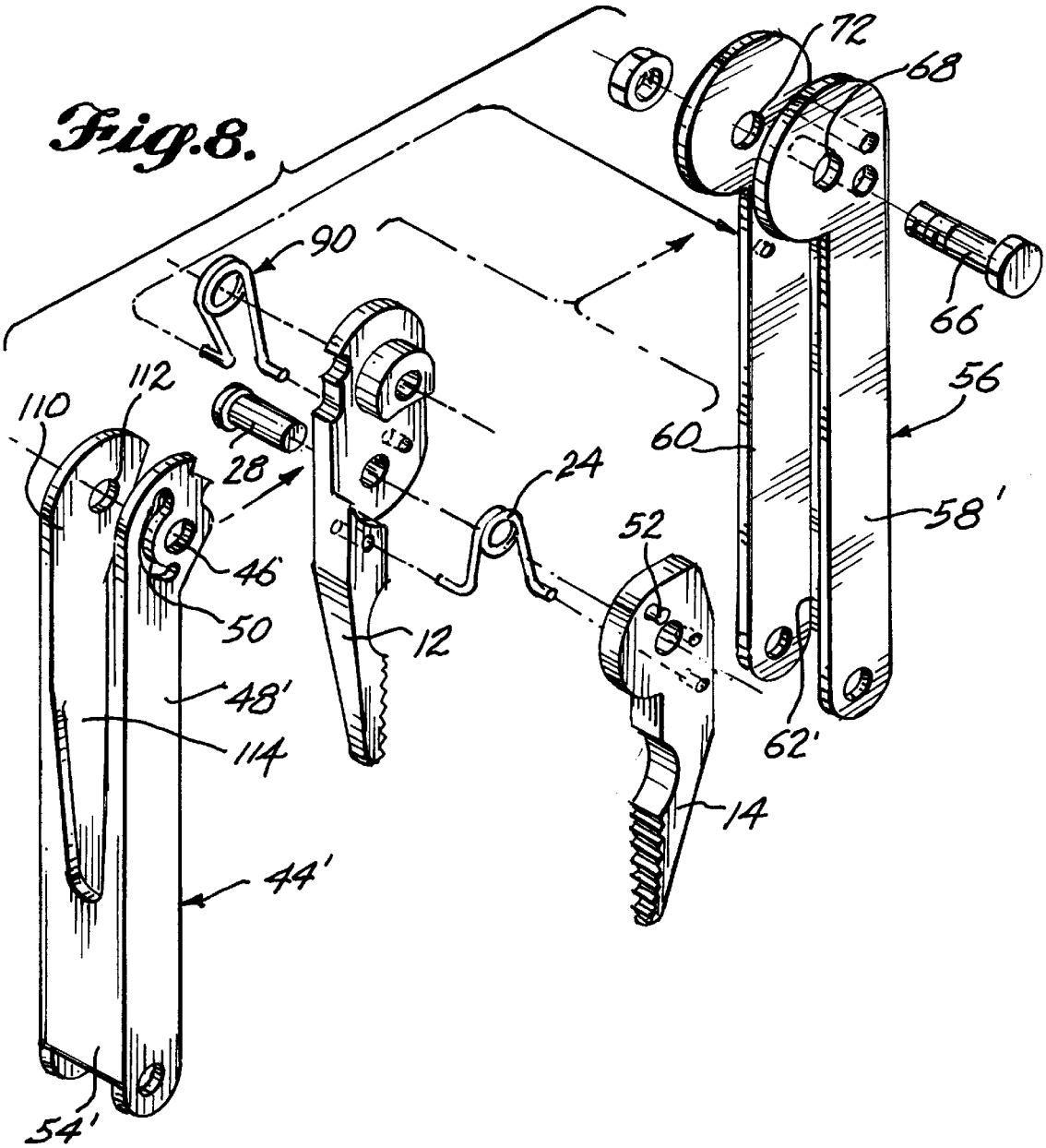
FIG. 8 is a top perspective of a second embodiment of a hand tool with retractable jaws in accordance with the present invention, with parts shown in exploded relationship.
Figure 12:
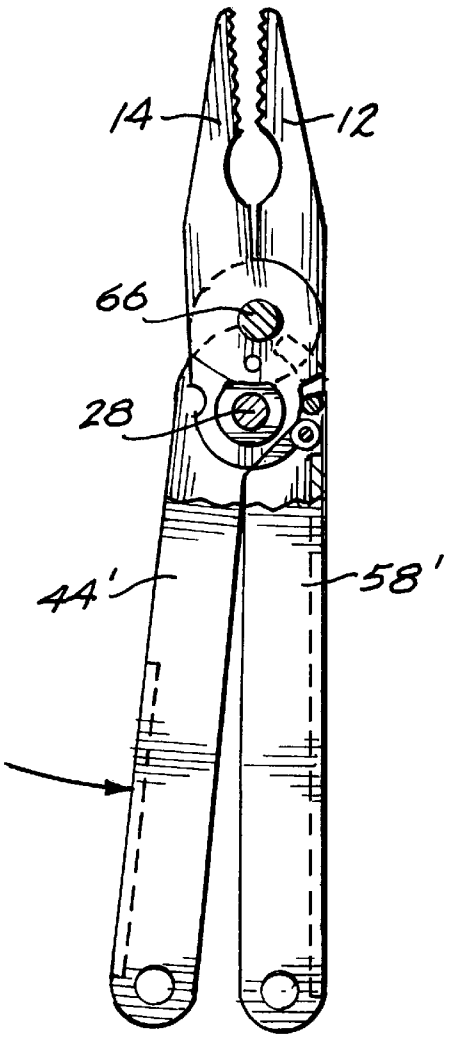
FIGS. 11 and 12 are corresponding top plans of the tool of FIG. 8 illustrating the open position of the tool, with parts broken away and parts in different positions.
Figure 11:
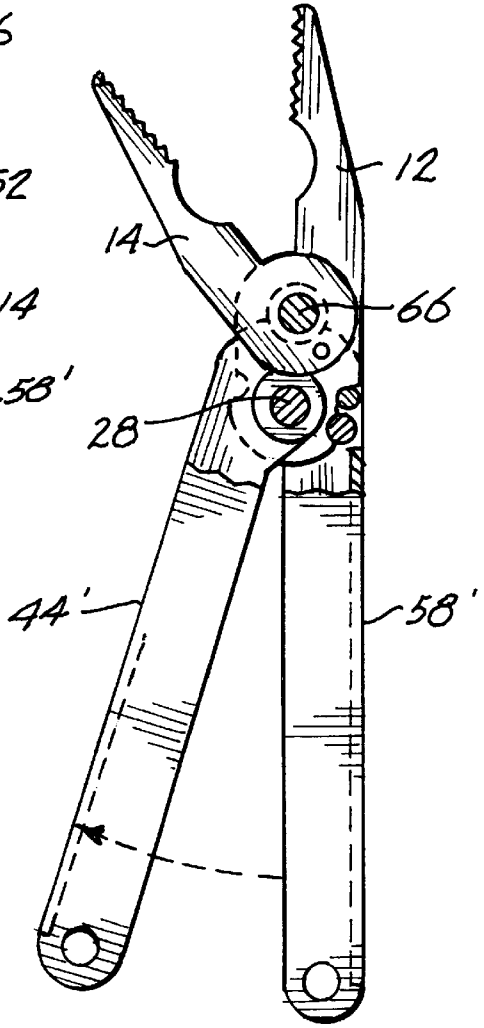
Figure 10:
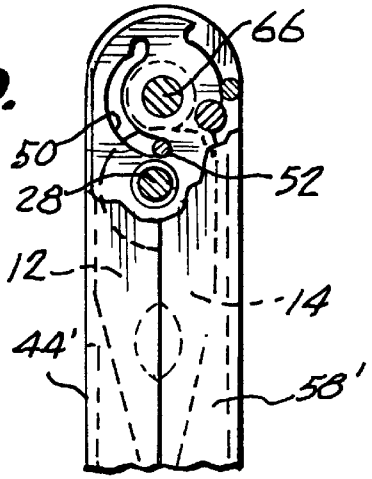
FIGS. 9 and 10 are corresponding top plans of the tool of FIG. 8 with parts assembled and illustrating the tool in a closed position, parts being broken away in each instance.
Figure 9:
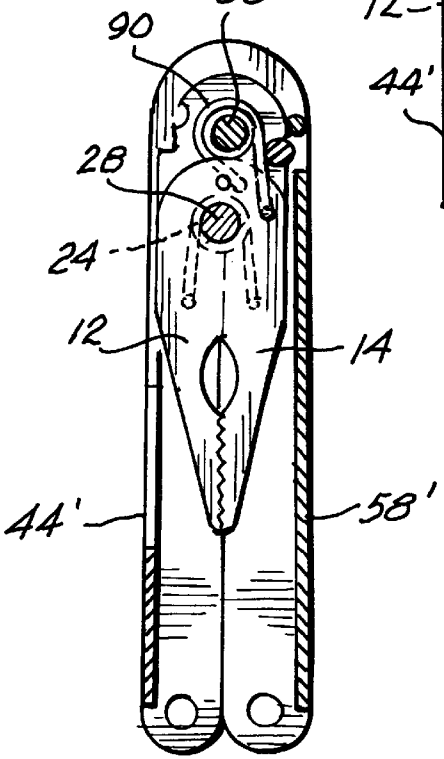

In the first embodiment of the present invention described above, both the assembly of jaws 14 and 18 and the second handle or lever 44 can be nested in the first handle 56. In the embodiment of the present invention illustrated in FIGS. 8–12, modified handles are used which cooperate to form a housing for the jaw assembly. With reference to FIG. 8, the assembly of jaws 12 and 18, biasing spring 24 and pivot pin or rivet 28 is identical to that previously described. The modified first handle 56' still includes a top plate 58' and bottom plate 60' interconnected at one side by a web 62'. One end portion of the top plate has the hole 68 for the pivot bolt 66, and the corresponding end of the bottom plate has the pivot hole 72. However, plates 58' and 60' are of reduced width as compared to the corresponding plates 58 and 60 of the first described embodiment. The second handle 44' has a flat top plate portion 48' with the pivot hole 46 for mounting on bolt 66, and the arcuate slot 50 for receiving the peg 52 of the second jaw 14. Also, similar to the first described embodiment, a flange 54' projects downward from the swinging end portion of the plate 48'. However, the second handle 44' also includes a flat bottom plate portion 110 integral with the flange or web 54' and having a pivot hole 112 aligned with hole 46 of the top plate 48'. The spacing of the top and bottom plates 48' and 110 of the second handle 44' is sufficient to receive the jaw assembly between them, and the spacing between the top and bottom plates 58' and 60' of handle 56' is sufficient to receive the second handle 44'. Finally, the flange or web 54' of the second handle has an opening 114 sized for passage of the jaw assembly when it is moved from the closed position shown in FIGS. 9 and 10 to the open position shown in FIGS. 11 and 12. During opening, the jaw assembly swings past the second handle, through the opening 114, and through a much smaller angle than the second handle which remains in a position for grasping by a user. The latch mechanism is not shown in FIG. 8, but is identical to that of the first described embodiment, and operation of the second embodiment is identical to the first. In the closed position illustrated in FIGS. 9 and 10, the jaws are concealed in the composite housing formed cooperatively by the two handles 56' and 44', whereas in the open position illustrated in FIGS. 11 and 12, the first jaw 12 is locked to the first handle 56' and the working end portion 20 of the second jaw 18 is movable toward and away from the working end portion 14 of the first jaw by movement of the second handle.

While the preferred embodiment of the invention has been illustrated and described, it will be appreciated that various changes can be made therein without departing from the spirit and scope of the invention. For example, the specific types of springs are exemplary and other types could be used. Instead of a torsion spring 90 to bias the jaw assembly to the extended or open position, a leaf spring could be provided on the web 62 or 62' of the first handle 56 or 56' to "throw" the jaw assembly when the latch mechanism is released. Another alternative is to delete the spring altogether, in which case the tool could be opened with a flick of the wrist. Nevertheless, the embodiments illustrated are preferred to achieve a positive force to swing the jaw assembly open.

The embodiments of the invention in which an exclusive property or privilege is claimed are defined as follows:

1. A hand tool comprising:

a jaw assembly having a first jaw and a second jaw pivoted to the first jaw for relative swinging of the two jaws about a first axis;

a first handle pivotally carrying said jaw assembly for swinging through a first angle between a compact closed position and an extended open position;

a latch normally interconnected between said first handle and said jaw assembly for normally locking said jaw assembly in the compact closed position, said latch being releasable manually to free said jaw assembly for movement from the compact closed position to the extended open position, said first and second jaws having working end portions moveable relatively toward and away from each other when said jaw assembly is in the extended open position; and a second handle pivotally connected to said first handle for swinging relative thereto through a second angle much smaller than the first angle, said second handle being interconnected with one of said jaws for effecting relative movement of said jaw working end portions when said jaw assembly is in the extended open position by movement of said second handle relative to said first handle.

2. The hand tool defined in claim 1, including means biasing the jaw assembly toward the extended open position such that the jaw assembly is moved automatically to the extended open position from the compact closed position when the latch is released.

3. The hand tool defined in claim 2, in which the latch is interconnectable with the jaw assembly when the jaw assembly is in the extended open position for locking the jaw assembly to the first handle when the jaw assembly is in the extended open position.

4. The hand tool defined in claim 1, in which the second handle is shaped for swinging of the jaw assembly past the second handle when the jaw assembly moves from the compact closed position to the extended open position.

5. The hand tool defined in claim 1, in which the second handle has an opening for passage of the jaw assembly through said opening when the jaw assembly moves from the compact closed position to the extended open position.

6. A hand tool comprising:

ajaw assembly having a first jaw and a second jaw pivoted to the first jaw for relative swinging of the two jaws about a first axis;

a first handle pivotally carrying the jaw assembly for swinging through a first angle between a compact closed position and an extended open position; and a second handle pivotally connected to the first handle for swinging relative thereto through a second angle much smaller than the first angle, the second handle being shaped for passage of the jaw assembly past the second handle when the jaw assembly moves from the compact closed position to the extended open position, the first and second jaws have cooperating working end portions moveable relatively toward and away from each other when the jaw assembly is in the extended open position, the second handle being interconnected with the jaw assembly for effecting relative movement of the working end portions of the jaws by movement of the second handle relative to the first handle.

7. The hand tool defined in claim 6, in which the first handle has a channel in which the jaw assembly is nested when in the compact closed position.

8. The hand tool defined in claim 6, in which the first handle and the second handle cooperatively form a channel in which the jaw assembly is nested when in the compact closed position.

9. The hand tool defined claim 6, in which the second handle has an opening for passage of the jaw assembly through said opening when the jaw assembly moves from the compact closed position.

10. The hand tool defined in claim 6, including means biasing the jaw assembly toward the extended open position in combination with means biasing the jaws relatively apart.

* * * * *

UNITED STATES PATENT AND TRADEMARK OFFICE

CERTIFICATE OF CORRECTION

PATENT NO. : 5,957,013
DATED : September 28, 1999
INVENTOR(S) : S. Frazer

It is certified that error appears in the above-identified patent and that said Letters Patent is hereby corrected as shown below:

Title page, column 1,
[*] Notice, insert in appropriate order the following:

-- [*] Notice: This patent is subject to a terminal disclaimer. --

Signed and Sealed this

Second Day of October, 2001

*Attest:*

Nicholas P. Godici

NICHOLAS P. GODICI
*Acting Director of the United States Patent and Trademark Office*

*Attesting Officer*